US005882178A

United States Patent [19]

Hudson et al.

[11] Patent Number: 5,882,178

[45] Date of Patent: Mar. 16, 1999

[54] IMPELLER AND SHAFT COUPLING

[75] Inventors: James H. Hudson; Ronald J. De Groot, both of Appleton, Wis.

[73] Assignee: Delaware Capital Formation, Inc., Wilmington, Del.

[21] Appl. No.: 822,503

[22] Filed: Mar. 24, 1997

[51] Int. Cl.[6] ..... F04D 29/34

[52] U.S. Cl. ..... 416/204 R; 415/218.1; 415/216.1; 403/334

[58] Field of Search ..... 416/204 R; 415/218.1, 415/216.1; 403/334, 37

[56] References Cited

U.S. PATENT DOCUMENTS

| | | | |
|---|---|---|---|
| 2,892,503 | 6/1959 | Hood Jr. et al. | 416/204 R |
| 3,019,039 | 1/1962 | Clavell | 416/204 R |
| 3,612,719 | 10/1971 | Nomura | 415/208.1 |
| 3,715,176 | 2/1973 | Kerklo | 415/216.1 |
| 4,788,740 | 12/1988 | Sovis | 416/204 R |
| 5,188,478 | 2/1993 | Bitsch et al. | 403/334 |

FOREIGN PATENT DOCUMENTS 478132 7/1975 U.S.S.R. .

*Primary Examiner*—John T. Kwon
*Attorney, Agent, or Firm*—Foley & Lardner

[57] ABSTRACT

An improved compressor shaft and impeller for an overhung centrifugal compressor are disclosed that enable the hydraulic attachment and release of the impeller and shaft. The shaft and impeller are also keyed together to enhance their torsional load carrying ability. The impeller and shaft have mating tapered turns that provide precision alignment and mating keyed turns axially adjacent to the mating tapered turns that are mechanically coupled, typically by a removable key. The shaft has a hydraulic passageway that connects to the tapered interface between the shaft and the impeller. By providing hydraulic pressure to this passageway, the tapered surfaces can be forced apart to more easily remove the impeller. An annular piston is disposed between the shaft and the impeller that also communicates with the hydraulic passageway. Hydraulic fluid acting on the piston forces the impeller and the shaft apart in an axial direction.

9 Claims, 3 Drawing Sheets

IMPELLER AND SHAFT COUPLING

FIELD OF THE INVENTION

The present invention relates generally to centrifugal compressors. More particularly it relates to structures for coupling and decoupling impellers and shafts of centrifugal impellers.

BACKGROUND OF THE INVENTION

In the field of centrifugal compressors, the attachment and removal of compressor impellers from compressor shafts is of continuing concern. The mounts must be secure enough to hold the impeller onto the compressor shaft, yet must also allow the compressor impeller to be relatively easily removed. One method of coupling an impeller to an impeller shaft is to provide the impeller with a longitudinally tapered cylindrical hole to mate with a similarly tapered portion of the compressor shaft. In this arrangement the compressor shaft typically has a threaded end portion adjacent to a tapered portion. The impeller is placed over the threaded portion on the end of the shaft until the tapered portion of the impeller engages the tapered portion of the shaft, leaving the threaded portion exposed. A lock nut is then screwed onto the threaded portion of the shaft and tightened, forcing the impeller taper firmly against the shaft taper, securing them together. This mounting method is often sufficient for low speed and low torque compressor applications. Unfortunately, a tapered fit such as this cannot counteract significant torsional loads. As the speed and the torque of a compressor increase, the tapered portion of the impeller will spin on the shaft. The advantage of the tapered fit is the ease of removal. An impeller with a tapered fit need only be moved axially about 25 inches to release its frictional grip on the shaft. When an impeller having a cylindrical bore is fitted onto a cylindrical portion of a shaft, the impeller must be press fit over the entire length of the cylindrical mating surfaces, typically 5–10 inches. This may require heating the impeller so it can be easily slid this 5–10 inches.

One method of preventing this spin is to mount the impeller hydraulically on the shaft. In this method, hydraulic fluid under pressure is injected axially into the shaft and then is conducted radially outward between the tapered impeller surface and the tapered shaft surface as the impeller is installed. The hydraulic fluid provides two benefits. First, it reduces the friction between the impeller and the shaft as the impeller is installed and second, the fluid pressure between the tapered surfaces expands the tapered bore of the impeller allowing it to be pushed even farther onto the tapered portion of the shaft. Once the impeller is in the proper position, the hydraulic pressure is released and the impeller taper contracts to fix it more firmly onto the compressor shaft than would otherwise be provided. The hydraulic fit also has the advantage of eliminating the use of torches, heaters or other devices for installation and removal. These implements significantly increase the risk of fire and explosions in chemical plant environments.

An alternative method for fixing the impeller on the shaft is to key the tapered surfaces of the impeller and the shaft together. Typically, an oval slot is milled in the compressor shaft taper and a flat key inserted in this slot. A mating keyway is milled into the inner tapered surface of the impeller. To assemble the two, the key is aligned with the keyway slot in the impeller and the impeller is forced onto the compressor shaft. This provides the advantage of the tapered coupling ease of installation as well as the keyed coupling for absorbing torsional stresses. Typically, if the impeller starts to spin with respect to the shaft, it rotates a fraction of a degree at best. The key prevents any further relative rotation and thereby carries the torsional load between the shaft and the impeller. Unfortunately, when a key is employed between the tapered portions of the impeller and the shaft, the hydraulic mounting method cannot be employed due to the irregular surface and leakage paths caused by the keyed construction.

An alternative design incorporating the benefits of the hydraulic mount and the keyed construction has also been employed. In this prior art device, a separate locking ring is placed over the end of the compressor shaft once the impeller is hydraulically installed. This ring, called a "torque plate" is placed over the portion of the compressor shaft that extends completely through the impeller. Once it is placed around the shaft, the lock nut is then screwed onto the end of the compressor shaft to hold the shaft impeller and torque plate together. The torque plate is keyed to fit into both the stub end of the compressor shaft and the impeller, acting as a large external torsional coupling between the two, transmitting torque from the compressor shaft to the impeller. This design has serious limitations, however. Since the torque plate is an additional element disposed between the impeller and the lock nut, the compressor shaft must be lengthened, which increases the overhang of the compressor. Furthermore, the torque plate adds a significant amount of mass to the impeller/shaft assembly. The additional mass further increases the overhang.

What is needed is a new impeller shaft mounting structure that will provide the benefits of a hydraulically mounted fit with the torsional capacity and reduced additional mass of a keyed connection.

SUMMARY OF THE PRESENT INVENTION

The present invention provides an improved apparatus for coupling an impeller and a shaft in a high speed compressor that provides for the above needs. Thus, in accordance with the present invention, a compressor shaft for an overhung centrifugal compressor is provided including a threaded end turn, a tapered turn adjacent to the threaded end portion having a first outer diameter smaller than a second outer diameter, and a hydraulic passageway communicating with an outer surface of the tapered turn; and a keyed turn adjacent to the tapered turn having another diameter greater than the second outer diameter, wherein the tapered turn includes a hydraulic passageway in fluid communication with the surface of the tapered turn.

This shaft is coupled to a compressor impeller for an overhung centrifugal compressor that includes a plurality of vanes; an impeller hub coupled to the vanes having a shaft-receiving passageway; a tapered inner surface disposed in the shaft-receiving passageway having first and second inner diameters, wherein the first diameter is smaller than the second diameter; and a keyed inner surface disposed in the shaft-receiving passageway having a diameter greater than the first and second inner diameters.

In accordance with a second embodiment of the invention, a compressor impeller and mating compressor shaft for an overhung centrifugal compressor is provided including a compressor shaft having a threaded turn, a first tapered turn and a first keyed turn disposed on adjacent longitudinal portions of the compressor shaft, a compressor impeller having a second tapered turn and a second keyed turn disposed along an internal passageway, and a releasing piston disposed between the impeller and the compressor shaft, wherein the impeller and the compressor have a rotational axis, and wherein the first and second tapered turns are in contact and the first and second keyed turns are mechanically coupled by a key means, and the releasing piston is disposed axially between the key means and those portions of the first and second keyed turns that are in contact.

Other principal features and advantages of the invention will become apparent to those skilled in the art upon review of the following drawings, the detailed description and the appended claims.

Figure 1:
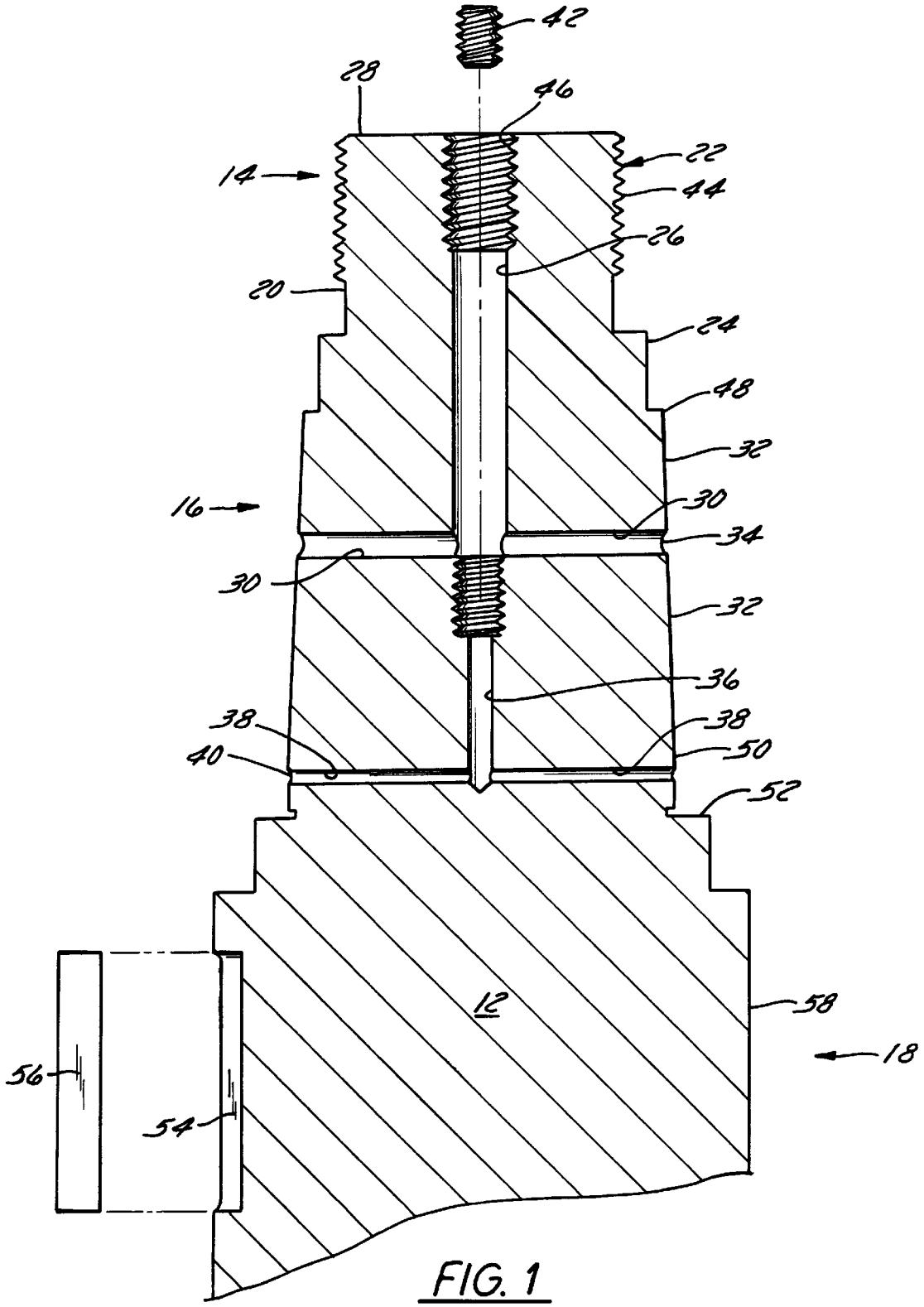
FIG. 1 is a cross-sectional view of a compressor shaft in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The subject of this application is generally centrifugal compressors. To describe the interrelationship and relative positions of various elements of the embodiments, certain naming conventions have been chosen. In this description, therefore, the term "turn" when referring to the impeller hub means a longitudinal (axial) section of the impeller hub and especially the interior surface of that section. When referring to the compressor shaft it means a longitudinal (axial) section of the compressor shaft and in particular the machined outer surface of that section.

FIG. 1 is a cross sectional view of a compressor shaft 12. The compressor shaft can be axially divided into a series of turns. Specifically, a threaded turn 14 is located at the end of the compressor shaft 12, a tapered turn 16 is located adjacent to threaded turn 14, and a keyed turn 18 is located adjacent to tapered turn 16. Threaded turn 14 includes a clearance turn 20 disposed between threads 22 of threaded turn 14 and shoulder 24 of tapered turn 16. An axial hydraulic passageway 26 is provided in end face 28 of compressor shaft 12. This passageway extends axially through the threaded turn into the tapered turn of the compressor shaft. Two transverse passageways 30 are provided in fluid communication with passageway 26 and with tapered outer surface 32 of tapered turn 16. Passageways 30 communicate with annular groove 34 which extends circumferentially around tapered surface 32. Passageway 26 has a pilot hole 36 that is threaded and in fluid communication with transverse passageways 38. Transverse passageways 38 fluidly couple hydraulic passageway 26 to annular groove 40 circumferentially disposed about tapered surface 32. Pilot hole 36 is adapted to receive threaded plug 42 which, when screwed into pilot hole 36, blocks off fluid communication between hydraulic passageway 26 and transverse passageways 38.

Threaded turn 14 has an external thread 44 adapted to engage an impeller lock nut (not shown). In addition, threaded turn 14 has an internal thread 46 disposed on the inner diameter of hydraulic passageway 26 and adapted to couple hydraulic passageway 26 to an external source of pressurized hydraulic fluid.

Figures 2, 3:
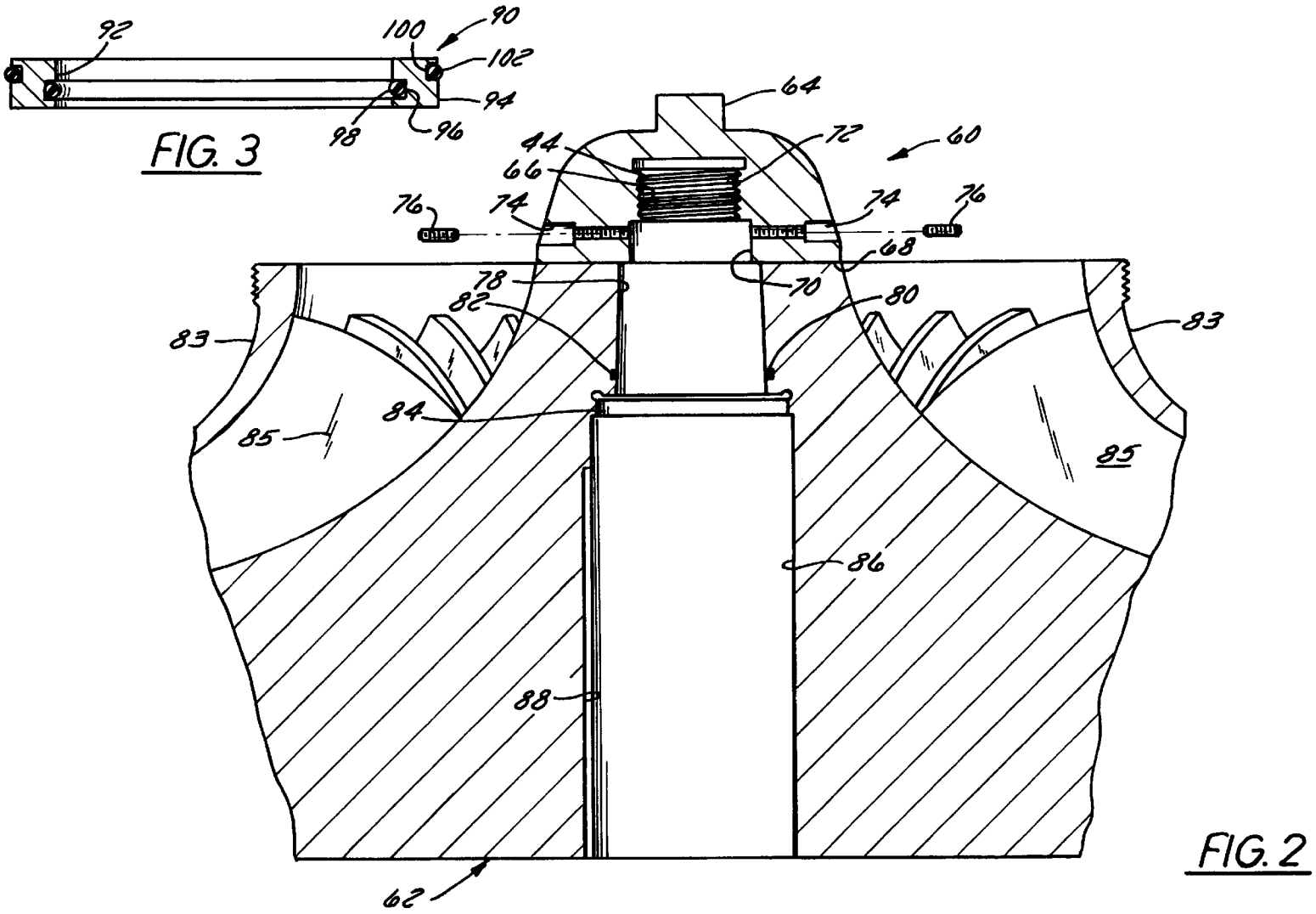
FIG. 2 is a cross-sectional view of an impeller adapted to engage with the compressor shaft of FIG. 1.
FIG. 3 is a cross-sectional view of a releasing piston adapted to be disposed between the compressor shaft and impeller of FIGS. 1 and 2.

Clearance turn 20 typically has a smaller outside diameter than thread 44 of threaded turn 14, and provides clearance for the threads of the impeller lock nut (FIG. 2) when it is screwed onto threads 44. Tapered surface 32 on tapered turn 16 is adapted to couple with a matching surface on the inside of the impeller hub (FIG. 2). Annular grooves 34 and 40 are provided to allow pressurized hydraulic fluid to be dispersed evenly about tapered surface 32. The taper shown here is exaggerated. In practice, the taper is typically between ¼ and ¾ inches per foot or one degree. Tapered surface 32 is preferably circular in cross section and has an outermost diameter 48 smaller than an innermost diameter 50.

Keyed turn 18 is adjacent to tapered turn 16 and typically has a diameter greater than innermost diameter 50 of tapered turn 16. A shoulder 52 is typically provided between tapered turn 16 and keyed turn 18. Keyed turn 18 also has a recess or slot 54 adapted to receive a key 56. When key 56 is inserted into recess 54, a portion of key 56 protrudes from the recess. This protrusion is adapted to mate with a keyway in the impeller hub (FIG. 2) having substantially the same width as the key. Alternatively, slot 54 can be dispensed with and a protrusion can be formed in the outer surface 58 of keyed turn 18. Outer surface 58 typically has a constant diameter.

FIG. 2 is a cross-sectional view of a lock nut and impeller adapted to be coupled to the compressor shaft of FIG. 1. Although lock nut 60 and impeller 62 are shown adjacent to each other, this is for convenience of illustration. Typically, there is no contact between the two until they are successively and separately mounted on the compressor shaft. Lock nut 60 has wrenching flats 64 on an outermost end of the lock nut. The lock nut is tightened by applying a wrench to the wrenching flats and tightening the lock nut on the compressor shaft. A threaded hole 66 extends into the lock nut from face 68 on the side of the lock nut opposite that of wrenching flat 64. This hole has a relief turn 70 and a threaded turn 72 adapted to engage threaded turn 14 of shaft 12 (FIG. 1). Set screw holes 74 are threaded and are adapted to receive set screws 76. During assembly, once the lock nut is screwed on the compressor shaft and torqued appropriately, set screws 76 are screwed into set screw holes 74 until they engage clearance turn 20 (FIG. 1) thereby preventing lock nut 60 from rotating with respect to shaft 12 (FIG. 1) and coming loose.

Impeller 62 has a tapered turn 78 having the same taper as tapered turn 16 of compressor shaft 12 (FIG. 1). An O-ring groove 80 is provided at the inner end of tapered turn 78 and is fitted with O-ring 82. A piston receiving turn 84 is formed adjacent to the larger diameter end of tapered turn 78. Turn 84 is adapted to receive and guide a piston (FIG. 3) discussed below.

Keyed turn 86 is provided adjacent to the piston receiving turn 84 and is adapted to couple with keyed turn 18 of compressor shaft 12. The axial clearance between keyed turn 86 and keyed turn 18 (FIG. 1) will vary depending upon the application and the size of the compressor shaft. A typical radial clearance between the two will be between 0.020 inches and 0.030 inches. A keyway 88 is provided in keyed turn 86. This keyway is adapted to receive key 56 (FIG. 1). The impeller includes a plurality of vanes 85 coupled to the impeller hub and an impeller cover 83 coupled to the outermost edges of the vanes. This construction defines a plurality of discrete gas passageways disposed circumferentially around the impeller hub.

FIG. 3 is a cross-sectional view of releasing piston 90. Piston 90 has an inner diametral surface 92 and an outer diametral surface 94. Inner surface 92 has an O-ring groove 96 in which O-ring 98 is inserted. Outer surface 94 has an O-ring groove 100 in which O-ring 102 is inserted. When the compressor is assembled, piston 90 is disposed between the impeller and shaft such that inner surface 92 is adjacent to compressor shaft 12 and outer surface 94 is adjacent to impeller 62. Releasing piston 90 is disposed in piston receiving turn 84 (FIG. 2) of impeller 62 as shown in FIG. 4.

Figure 4:
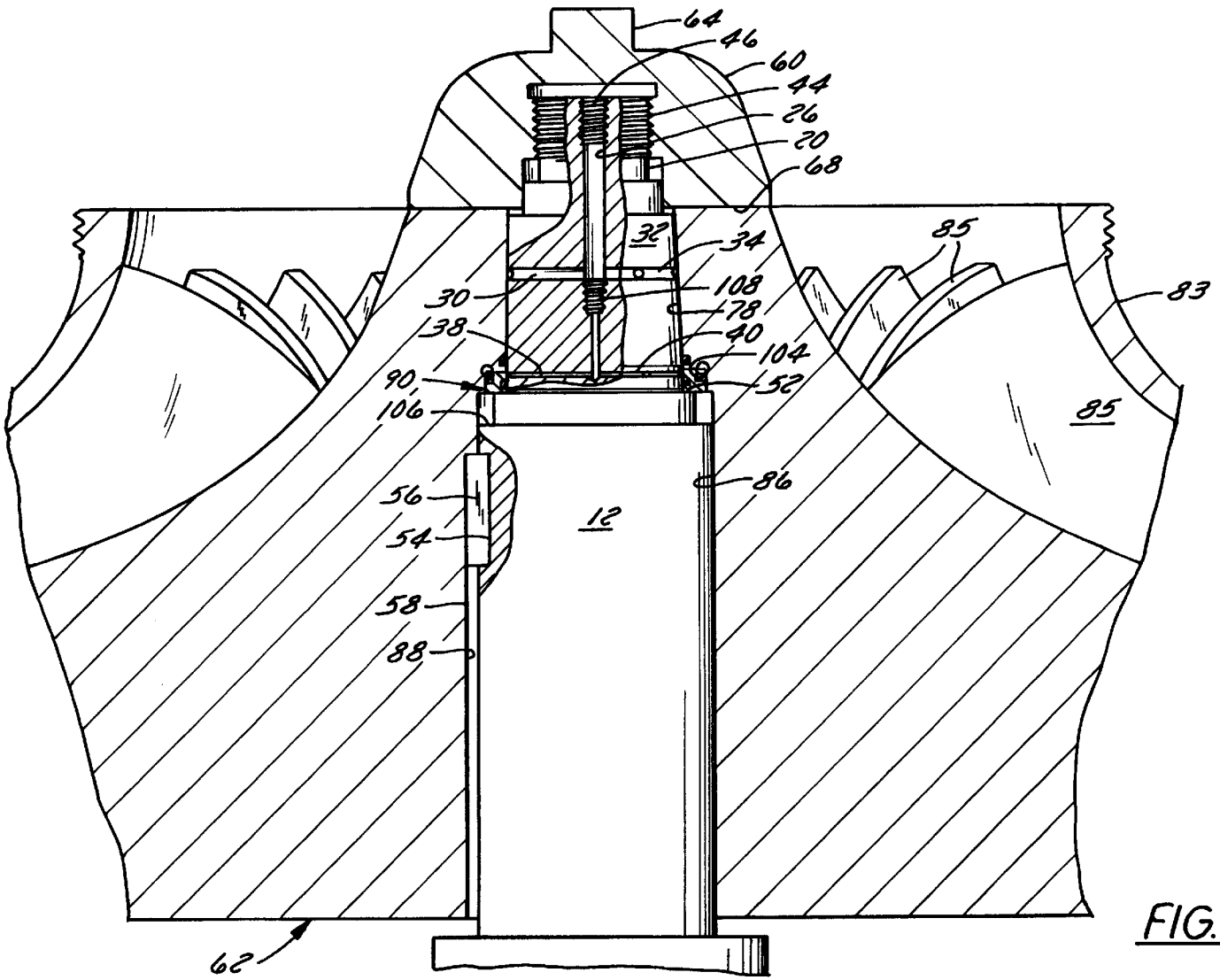
FIG. 4 is a partial cross-sectional view of the compressor shaft, impeller and releasing piston of FIGS. 1–3.

FIG. 4 is a partial cross-sectional cutaway view of impeller 62 mounted on compressor shaft 12 with releasing piston 90 disposed between them. To release impeller 62 from compressor shaft 12, lock nut 60 is first removed by applying a wrench to wrenching flats 64. Once the lock nut is removed, a hydraulic fitting coupled to a source of pressurized hydraulic fluid is connected to internal thread 46. When hydraulic pressure is applied, it is transmitted through axial hydraulic passageway 26 and outward through transverse passageways 30, 38. The fluid fills annular grooves 34, 40 and exerts outward pressure on tapered turn 78 of impeller 62. This tends to expand tapered turn 78 away from tapered surface 32 on compressor shaft 12. In addition to this outward force expanding impeller 62, an axial force is exerted by the hydraulic fluid that forces impeller 62 off compressor shaft 12. As hydraulic fluid fills annular groove 40, it also creates and fills a gap between releasing piston 90 and impeller 62. This gap is formed between the annular abutting surfaces indicated as Item 104 in FIG. 4. O-rings 102 and 98 on releasing piston 90 prevent the fluid in annular groove 40 from leaking outward toward outer surface 58 of compressor shaft 12. As the hydraulic fluid fills the gap created between the abutting faces at 104, it forces releasing piston 90 towards shoulder 52, thereby forcing impeller 62 away from compressor shaft 12. Thus, hydraulic fluid filling annular groove 34 serves to expand the impeller hub radially outward and away from compressor shaft 12 and hydraulic fluid in annular groove 40 serves to force the impeller off compressor shaft 12 in an axial direction.

During impeller removal, key 56 is maintained in recess 54 in compressor shaft 12 as impeller 62 moves away from compressor shaft 12. As impeller 62 is separated from shaft 12, key 56 translates through keyway 88 in impeller 62 until it leaves keyway 88 entirely, at which point it can be removed from recess 54.

In this embodiment, therefore, slot 54 surrounds key 56 and maintains it in a fixed axial position with respect to compressor shaft 12. Similarly, keyway 88 allows key 56 to slide in an axial direction with respect to impeller 62 yet prevents shaft 12 from rotating with respect to impeller 62. These positions could be reversed, however. Slot 54 could be disposed on the inner surface of keyed turn 86 of impeller 62, and keyway 88 could be disposed on outer surface 58 of keyed turn 18. In this configuration, the keyway on compressor shaft 12 would extend along compressor shaft 12 leftwardly (in FIG. 4) to shoulder 106.

The impeller and compressor shaft are reassembled in the following manner. First, a plug is screwed into threads 108 of pilot hole 36. This plug seals off transverse passageways 38 and annular groove 40 from the hydraulic supply coupled to internal thread 46. The impeller is then inserted onto the end of compressor shaft 12 (taking care to align keyway 88 with key 56 in compressor shaft 12). The impeller can be advanced until it is in substantially the same position as shown in FIG. 4. At this point, tapered surface 32 on the external surface of compressor shaft 12 and tapered turn 78 on the inside surface of the impeller hub are in close contact, and substantially seal off annular groove 34. Hydraulic fluid is then forced into passageway 26. This fluid passes down passageway 26 through transverse passageway 30 and into annular groove 34. Due to the close fit between the tapered surface of the impeller and the mating tapered surface of the compressor shaft, the fluid cannot easily leak out and significant hydraulic pressure is applied to expand the impeller outwardly. This outward expansion allows the impeller to be inserted even farther onto compressor shaft 12, at which point the hydraulic pressure is released and the impeller contracts, creating a tight force fit with compressor shaft 12. Since transverse passageways 38 and annular groove 40 are blocked off by plug 42, none of the hydraulic pressure applied during installation acts against releasing piston 90. Since releasing piston 90 is not pressurized by the hydraulic fluid, it does not push the impeller and compressor shaft 12 apart.

The structures disclosed above and the method of removing and installing the impeller show the significant advantage of providing a key coupling between the compressor shaft and the impeller disposed a distance away from the tapered force fit coupling.

Thus, it should be apparent that there has been provided in accordance with the present invention an improved impeller mount that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A compressor shaft for an overhung centrifugal compressor comprising:

a threaded end turn;

a tapered turn adjacent to the threaded end portion having a first outer diameter smaller than a second outer diameter, and a hydraulic passageway communicating with an outer surface of the tapered turn; and a keyed turn adjacent to the tapered turn having another diameter greater than the second outer diameter, wherein the tapered turn includes a hydraulic passageway in fluid communication with the surface of the tapered turn.

2. The compressor shaft of claim 1 wherein the keyed turn further comprises a coupling means adapted to couple the compressor shaft to a compressor impeller.

3. The compressor shaft of claim 2, wherein the key means includes a key slot formed in the outer surface of the keyed turn.

4. A compressor impeller for an overhung centrifugal compressor comprising:

a plurality of vanes;

an impeller hub coupled to the vanes having a shaft-receiving passageway;

a tapered inner surface disposed in the shaft-receiving passageway having first and second inner diameters;

wherein the first diameter is smaller than the second diameter; and a keyed inner surface disposed in the shaft-receiving passageway having a diameter greater than the first and second inner diameters.

5. The compressor impeller of claim 4 wherein the keyed inner turn further comprises a coupling means adapted to couple a compressor shaft to the impeller.

6. The compressor impeller of claim 5, wherein the coupling means further comprises a keyway disposed axially along the length of the compressor impeller.

7. A compressor impeller and mating compressor shaft for an overhung centrifugal compressor comprising:

a compressor shaft having a threaded turn, a first tapered turn and a first keyed turn disposed on adjacent longitudinal portions of the compressor shaft;

a compressor impeller having a second tapered turn and a second keyed turn disposed along an internal passageway, and a releasing piston disposed between the impeller and the compressor shaft, wherein the impeller and the compressor have a rotational axis, and wherein the first and second tapered turns are in contact and the first and second keyed turns are mechanically coupled by a key means, and the releasing piston is disposed axially between the key means and those portions of the first and second keyed turns that are in contact.

8. The compressor impeller and mating compressor shaft of claim 7, wherein the key means comprises:

a key slot in the first keyed turn;

a keyway in the second keyed turn; and a key disposed between the key slot and the keyway.

9. The compressor impeller and mating compressor shaft of claim 8, wherein the key means comprises:

a key slot in the second keyed turn;

a keyway in the first keyed turn; and a key disposed between the key slot and the keyway.

* * * * *